US010561231B1

(12) United States Patent
Cicia

(10) Patent No.: US 10,561,231 B1
(45) Date of Patent: Feb. 18, 2020

(54) GROUT CLEANING HAND TOOL

(71) Applicant: MASSACHUSETTS MUTUAL LIFE INSURANCE COMPANY, Springfield, MA (US)

(72) Inventor: Raymond Cicia, Springfield, MA (US)

(73) Assignee: Massachusetts Mutual Life Insurance Company, Springfield, MA (US)

( * ) Notice: Subject to any disclaimer, the term of this patent is extended or adjusted under 35 U.S.C. 154(b) by 102 days.

(21) Appl. No.: 15/402,182

(22) Filed: Jan. 9, 2017

(51) Int. Cl.

| | |
|---|---|
| ***A46B 9/02*** | (2006.01) |
| ***A46B 5/02*** | (2006.01) |
| ***A46D 1/00*** | (2006.01) |
| ***A46B 7/04*** | (2006.01) |

(52) U.S. Cl.
CPC ..... *A46B 9/02* (2013.01); *A46B 5/021* (2013.01); *A46B 7/044* (2013.01); *A46B 7/048* (2013.01); *A46D 1/0207* (2013.01); *A46B 2200/3033* (2013.01)

(58) Field of Classification Search
CPC ..... A46B 9/02; A46B 5/021; A46B 7/044; A46B 2200/3033
USPC ..... 15/143.1
See application file for complete search history.

(56) References Cited

U.S. PATENT DOCUMENTS 3,267,505 A 8/1966 Seufert et al.
3,795,933 A 3/1974 Seufert
3,926,545 A * 12/1975 Gujer ..... F23Q 2/285 431/122
3,984,892 A * 10/1976 Kyriakou ..... A46B 17/02 15/111
4,064,588 A 12/1977 Cooper
4,976,031 A * 12/1990 Miller ..... A01G 3/053 30/166.3
5,319,824 A * 6/1994 Cook, III ..... A46B 5/0075 15/106

(Continued)

FOREIGN PATENT DOCUMENTS

WO 2007/068026 A1 6/2007

OTHER PUBLICATIONS https://www.amazon.com/OCedar-Commercial-27225-Grout-Brush/dp/B00OA7O1EA amazon.com product description page for O'Cedar Commercial 27225 Grout Brush (Pack of 12), downloaded Mar. 29, 2017, 3 pages.

*Primary Examiner* — Henry T Crenshaw
(74) *Attorney, Agent, or Firm* — Eric L. Sophir; Dentons US LLP

(57) ABSTRACT

A grout cleaning hand tool includes a grout cleaning head assembly with a removable brush subassembly. An elongate handle extends upwardly from the grout cleaning head assembly and is held by an operator in a standing posture. The elongate handle includes a handle rod held by a first hand of the operator, and an auxiliary T-grip handle held by a second hand of the operator. The brush subassembly includes a long narrow bundle of bristles secured to a base, slidably mounted to a channel of the grout cleaning head assembly. The handle rod and the T-grip handle provide ergonomic positions for the operator to exert downward compression forces on the grout cleaning head assembly to facilitate cleaning grout lines in tiled floors. The brush subassembly may include a brush handle for detail-work grout cleaning while holding the brush subassembly close to the floor when removed from the head assembly.

19 Claims, 8 Drawing Sheets

(56) References Cited

U.S. PATENT DOCUMENTS

| | | | | | |
|---|---|---|---|---|---|
| 5,412,829 | A | * | 5/1995 | Hefner | A46B 7/02 15/160 |
| D375,842 | S | * | 11/1996 | Gringer | D4/132 |
| 5,809,604 | A | * | 9/1998 | Olstyn | B25G 3/06 15/111 |
| 6,059,475 | A | * | 5/2000 | Jafarmadar | A46B 13/04 15/50.3 |
| 6,073,298 | A | | 6/2000 | O'Brien | |
| 6,076,221 | A | * | 6/2000 | Bradshaw | A46B 7/04 15/160 |
| 7,811,022 | B2 | | 10/2010 | Bobrosky et al. | |
| 8,028,366 | B2 | | 10/2011 | Grabowski | |
| 8,201,297 | B2 | | 6/2012 | Fulmer | |
| 8,918,942 | B1 | | 12/2014 | Timmermeyer | |
| 9,044,131 | B1 | | 6/2015 | Pence | |
| 9,308,549 | B1 | * | 4/2016 | Kern | B05C 17/0222 |
| 9,420,932 | B2 | | 8/2016 | Hansen | |
| 2005/0214059 | A1 | * | 9/2005 | McEwan | E04F 21/165 401/140 |
| 2009/0077762 | A1 | * | 3/2009 | Daniels | A46B 7/04 15/111 |
| 2015/0096137 | A1 | | 4/2015 | Kayler | |
| 2017/0001296 | A1 | * | 1/2017 | Murphy | B25G 1/06 |
| 2017/0280961 | A1 | * | 10/2017 | Pellegrino | A46B 7/042 |

* cited by examiner

GROUT CLEANING HAND TOOL

TECHNICAL FIELD OF DISCLOSURE

The present disclosure relates to a tool for cleaning or stripping grout and more particularly to a tool for supporting a grout brush configured for cleaning lines of grout between tiles of a tiled floor.

BACKGROUND

A tiled surface commonly comprises a matrix of pre-cut pieces that have been permanently secured to an underlying support surface. The individual pieces are spaced apart and the spacing is typically filled with grout joints. The grout joints give stability to the matrix of tiles and helps keep the individual pieces from working loose over time. Grout is installed in the gaps between the installed tile to seal the surface and to provide a finished appearance. Grout is generally white in color and recessed below the surface of the tile. For example, a typical floor tile installation consists of a plurality of tiles bonded to an underlying subfloor by bonding material, including mortar and grout.

Grout is typically a porous cement and sand mixture. Due to the fact that moisture, and consequently dirt, tends to collect and be retained in the grout covered spaces between tiles, and due to the white color of the grout, the grout often requires cleaning. Because the surface of the grout is recessed below the surface of the tile, conventional cleaning implements may not effectively clean the grout. Accordingly, there has been a need in the art to devise an effective cleaning method for grout lines in tiled floors.

The grout cleaning process can be made somewhat easier by specialized brushes shaped to fit into individual lines of grout. To be effective, however, the heads of these brushes must be appropriately sized for the grout lines to be cleaned, and maintain this characteristic during use. A width-ways spread of the bristles can results in a brush that is too wide for effective cleaning of a grouted groove. Even when an appropriately-sized brush is chosen, cleaning the multitude of grout lines associated with most tiled surfaces is a daunting task. The lines of grout must still be cleaned one at a time.

There are a variety of cleaning brushes commercially available for grout cleaning. However, cleaning the grout lines using currently available brushes typically involves labor intensive scrubbing and brushing in a posture that is uncomfortable to a user including, for example, crouch, prone, leaning, or bending over. These awkward positions, in combination with the muscle strength required to reciprocally and repetitively move the brushes, severely limit a person's ability to clean the grout lines because of his or her limited stamina. Also, ergonomic difficulties of conventional grout cleaning activities increase the probability of causing or inducing injuries associated with engaging in such activities.

It is known to clean grout using tools that are designed for use by operators in a standing position. An example is a long-handled tool with an angled handle similar to a broom handle, including a brush attachment such as a nylon brush. These brush attachments greatly deform as the device is pressed down, and thus may not clean or strip the grout efficiently as more robust tools. Another example is a tool including a rigid rectangular plate, with an elongated handle connected to the upper surface of the plate. A tile scrubbing pad made of a fibrous material is connected to the bottom surface of the plate. When pressed down and moved using the elongated handle, this scrubbing pad may not clean or strip lines of grout as precisely and robustly as tools designed specifically for cleaning grout joints.

In summary, conventional grout scrubbing tools, even long-handled tools designed for use by an operator in a standing position, have various ergonomic and efficiency limitations as applied to the physically demanding task of cleaning or scrubbing grout joints.

SUMMARY

What is needed is a tool for stripping or cleaning grout, such as grout joints on tile floors, that is comfortable to use. As a related matter, operator use of the tool should not unduly tax the operator's stamina, or create a risk of injuries. An additional goal is that the tool be well adapted to cleaning and stripping grout, such as grout joints of tile floors, in an efficient manner.

Additionally, it is desirable to provide a hand-held tool embodying an ergonomically sound design for use by an operator use in a standing posture. A further goal is to provide a hand-held floor treatment tool configured to be held in a standing posture in carrying out floor treatment operations that require pressing down a work-head against a floor surface.

Disclosed herein is grout cleaning hand tool that includes a grout cleaning head assembly with a removable brush subassembly. An elongate handle extends upwardly from the grout cleaning head assembly and is held by an operator in a standing posture. In an embodiment, the elongated handle includes a handle rod and a T-grip handle, for two-handed engagement by the operator. In an embodiment, the handle rod and a T-grip handle provide ergonomic positions for the standing operator to exert downward compression forces on the grout cleaning head assembly to facilitate cleaning grout lines in tiled floors.

In an embodiment, the removable brush subassembly includes a brush handle to be held by an operator for cleaning grout with the brush subassembly when removed from the head assembly. In an embodiment, the brush subassembly is configured, when removed from the grout cleaning head assembly, for detail-work grout cleaning by the operator holding the long narrow brush subassembly in a sitting, kneeling, squatting, or crouching posture.

In an embodiment, the grout cleaning head assembly includes a support member with an insertion axis. The brush subassembly configured to be inserted to and removed from the support member along the insertion axis. In an embodiment, the brush subassembly includes a brush body extending along the insertion axis, and a long narrow bundle of bristles secured to the brush body. In an embodiment, the brush body is slidably mounted to a channel of the support member along an insertion axis. In an embodiment, the support member includes first and second ribs defining the channel. In one embodiment, the brush body is configured as the pin of a dovetail joint, and the channel of the support member is configured as the tail of the dovetail joint.

In an embodiment, the removable brush subassembly includes stiff bristles that resist collapsing when pressed against the grout lines in the tiled floor. In an exemplary embodiment, a long narrow bundle of bristles includes metal bristles configured to conform to grout lines in a tiled floor surface.

In an embodiment, the elongate handle of the grout cleaning hand tool includes a handle rod including a primary grip position to be held by a first hand of the operator in the standing posture, and an auxiliary handle joined to the handle rod to be held by a second hand of the operator. In one embodiment, the auxiliary handle includes a sleeve, and a T-grip joined to the sleeve and extending substantially perpendicular to the sleeve. The sleeve may be releasably secured to the handle rod to permit either or both axial and radial repositioning of the sleeve along the handle rod. In an embodiment, the elongate handle extends upwardly from the grout cleaning head assembly at an angle between 40° and 60° from a primary axis of the grout cleaning head assembly. In another embodiment, the elongate handle extends upwardly from the grout cleaning head assembly at an angle between 45° and 55° from a primary axis of the grout cleaning head assembly.

In another embodiment, a hand tool includes a work head, with a support member and a floor treatment implement secured to the support member. The floor treatment implement is adapted to floor treatment operations that require pressing down the floor treatment implement against a floor surface. The hand tool further includes an elongate handle that extends upwardly from the support member and is configured to be held by the operator in a standing posture. The elongate handle incorporates a handle rod and an auxiliary handle joined to the handle rod. The handle rod provides a primary grip position for a first hand of the operator, and the auxiliary handle includes a T-grip member that extends substantially perpendicularly to the handle rod and that provides a secondary grip position for a second hand of the operator. The handle rod and the auxiliary handle provide ergonomically sound grip positions for the operator to exert downward compression forces during floor treatment operations.

In an embodiment, a grout cleaning hand tool comprises a grout cleaning head assembly, comprising a support member including an insertion axis, and a brush subassembly configured to be inserted to and removed from the support member along the insertion axis for removable mounting to the support member, the brush subassembly including a long narrow bundle of bristles; and an elongate handle joined to the support member, extending upwardly from the grout cleaning head assembly; wherein the grout cleaning hand tool is configured for cleaning grout in a floor surface by an operator holding the elongate handle in a standing posture; and wherein the brush subassembly is configured, when removed from the grout cleaning head assembly, for cleaning the grout in the floor surface by the operator holding the brush subassembly close to the floor.

In an embodiment, a grout cleaning hand tool, comprises a grout cleaning head assembly, comprising a support member and a brush subassembly removably mounting to the support member; the brush subassembly comprising a base, a long narrow bundle of bristles secured to the base configured to clean grout lines in a tiled floor surface, and a brush handle joined to the base; and an elongate handle joined to the support member, extending upwardly from the grout cleaning head assembly, wherein the elongate handle comprises a handle rod and an auxiliary handle joined to the handle rod; wherein the grout cleaning hand tool is configured for cleaning the grout lines in the tiled floor surface by an operator holding the handle rod and the auxiliary handle while in a standing posture; and wherein the brush subassembly is configured, when removed from the grout cleaning head assembly, for cleaning the grout lines in the tiled floor surface by the operator holding the brush subassembly close to the tiled floor surface.

In an embodiment, A grout cleaning hand tool comprises a grout cleaning head assembly, comprising a support member including an insertion axis, and a brush subassembly configured to be inserted to and removed from the support member along the insertion axis for removable mounting to the support member, the brush subassembly comprising a base extending along the insertion axis and long narrow bundle of bristles secured to the base, wherein the base is slidably mounted to a channel of the support member along the insertion axis; and an elongate handle joined to the support member, extending upwardly from the grout cleaning head assembly; wherein the grout cleaning hand tool is configured for cleaning grout lines in a tiled floor surface by an operator holding the elongate handle in a standing posture.

In an embodiment, a hand tool comprises a work head comprising a support member and a floor treatment implement secured to the support member, the floor treatment implement being adapted to a floor treatment operation comprising pressing down the floor treatment implement against a floor surface, and an elongate handle joined to the support member and extending upwardly from the support member and configured to be held by the operator in a standing posture, wherein the elongate handle comprises a handle rod including a primary grip position configured to be held by a first hand of the operator, and an auxiliary handle joined to the handle rod and including a T-grip member extending substantially perpendicularly to the handle rod and configured to be held by a second hand of the operator.

In an embodiment, a hand tool comprises a work head comprising a support member and a floor treatment implement secured to the support member, the floor treatment implement being adapted to a floor treatment operation comprising pushing and pulling the floor treatment implement along a floor surface, and an elongate handle joined to the support member and extending upwardly from the support member and configured to be held by the operator in a standing posture, wherein the elongate handle comprises a handle rod including a primary grip position configured to be held by a first hand of the operator, and an auxiliary handle joined to the handle rod and including a T-grip member extending substantially perpendicularly to the handle rod and configured to be held by a second hand of the operator.

In an embodiment, a hand tool comprises a work head comprising a support member and a floor treatment implement secured to the support member, and an elongate handle joined to the support member and extending upwardly from the support member and configured to be held by the operator in a standing posture, wherein the elongate handle comprises: a handle rod including a primary grip position configured to be held by a first hand of the operator, and an auxiliary handle comprising a sleeve, and a T-grip member joined to the sleeve and extending substantially perpendicularly to the handle rod and configured to be held by a second hand of the operator, where the sleeve is releasably secured to the handle rod to permit either or both axial and radial repositioning of the sleeve along the handle rod, wherein the sleeve joins the T-grip member to the handle rod.

BRIEF DESCRIPTION OF THE DRAWINGS

Non-limiting embodiments of the present disclosure are described by way of example with reference to the accompanying figures which are schematic and are not intended to be drawn to scale. Unless indicated as representing the background art, the figures represent aspects of the disclosure.

DETAILED DESCRIPTION

Figure 1:
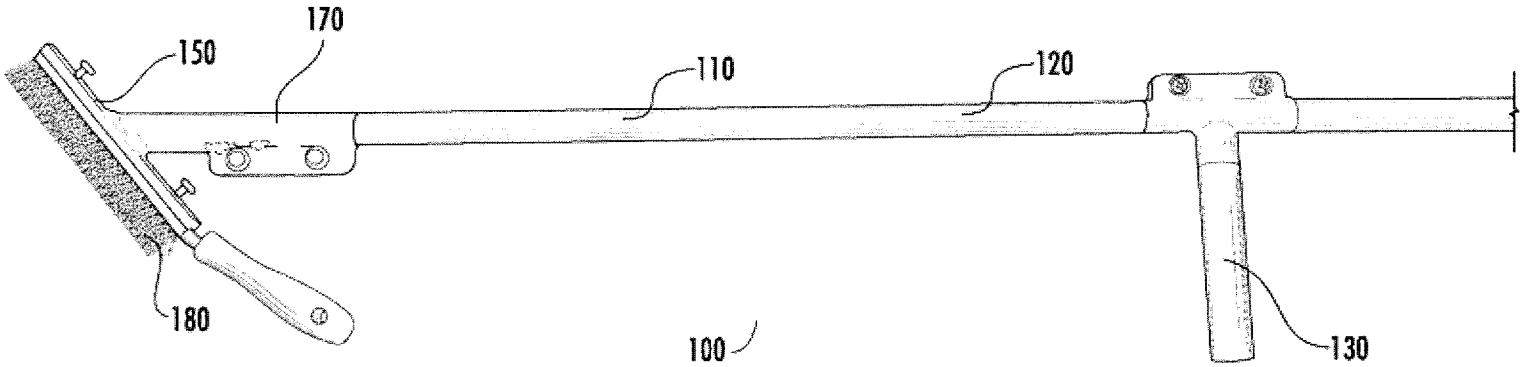
FIG. 1 is a partial perspective view of a grout cleaning hand tool, according to an exemplary embodiment.

The present disclosure is here described in detail with reference to embodiments illustrated in the drawings, which form a part hereof. Other embodiments may be used and/or other changes may be made without departing from the spirit or scope of the present disclosure. The illustrative embodiments described in the detailed description are not meant to be limiting of the subject matter presented here.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

Figure 6:
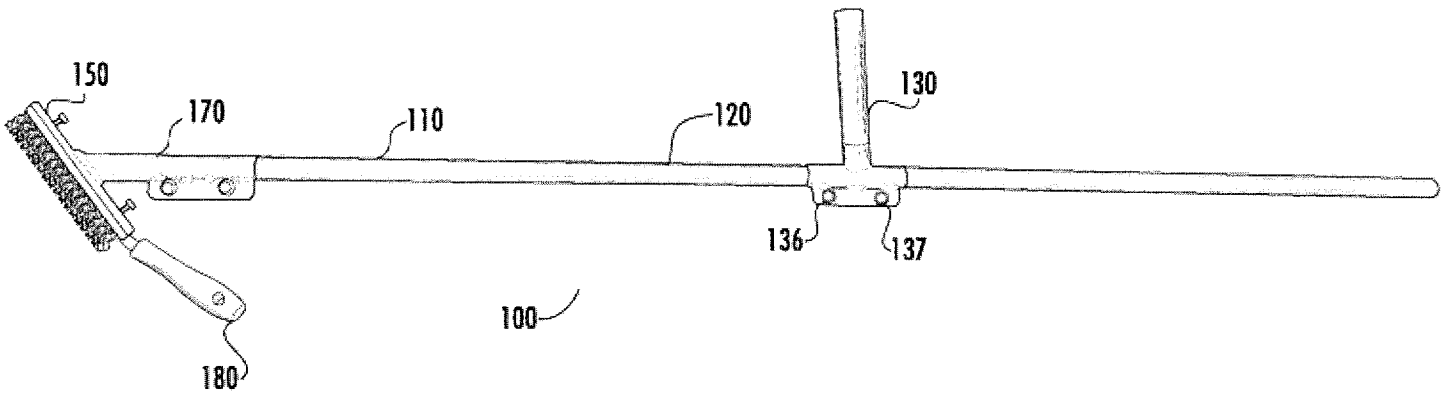
FIG. 6 is a perspective view of a grout cleaning hand tool.

Referring to FIGS. 1 and 6, a grout cleaning hand tool 100 includes an elongated handle 110 and a grout cleaning head assembly 150 (also called work head 150). The grout cleaning head assembly includes a support member and a removable brush subassembly 180. The elongated handle 110 includes a handle rod 120 and an auxiliary handle 130. The handle rod and auxiliary handle provide primary and secondary grip locations for an operator holding the grout cleaning hand tool 100 with both hands in a standing posture.

Figure 2:
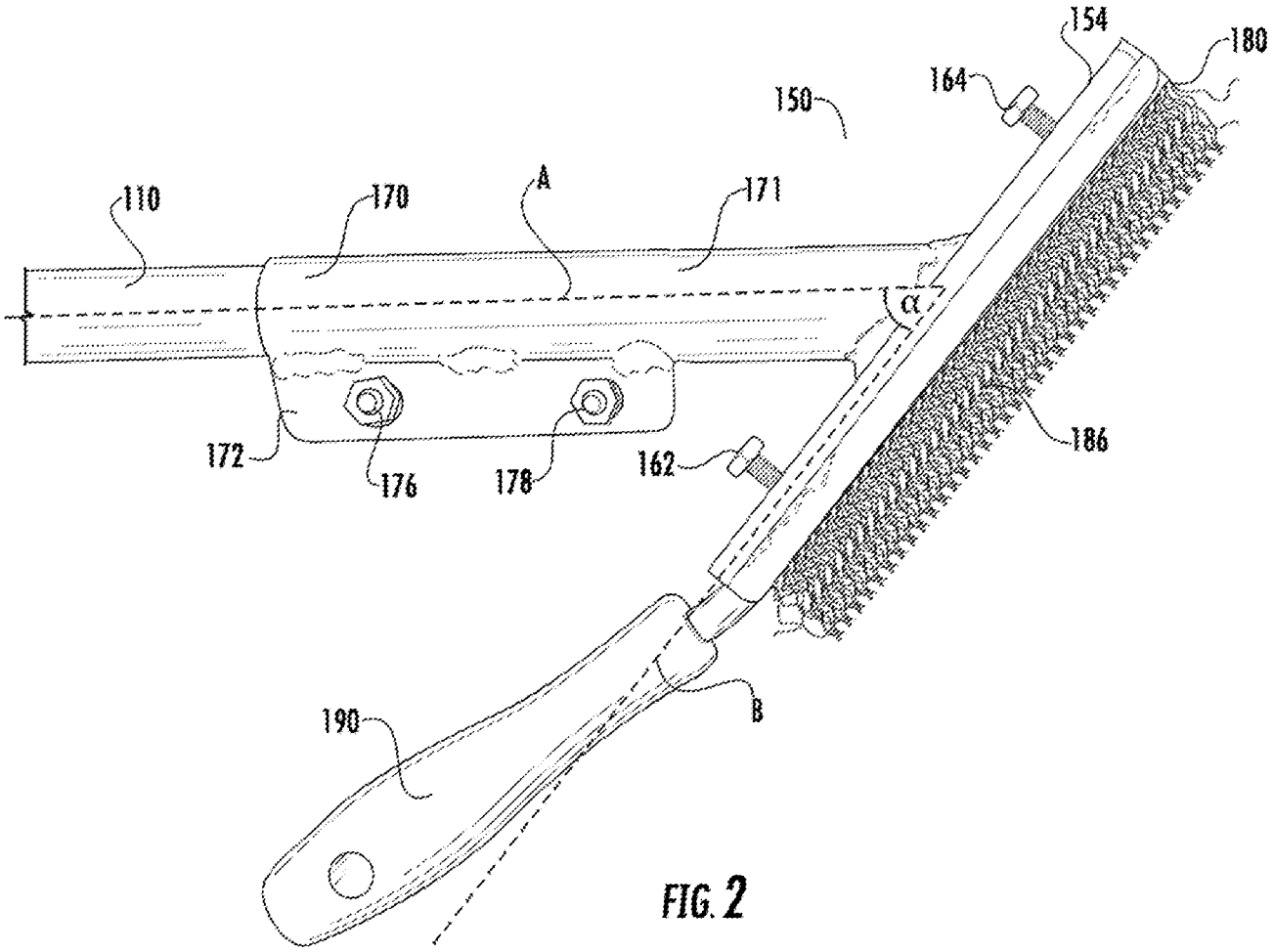
FIG. 2 is a perspective view of a grout cleaning head assembly.
Figure 4:
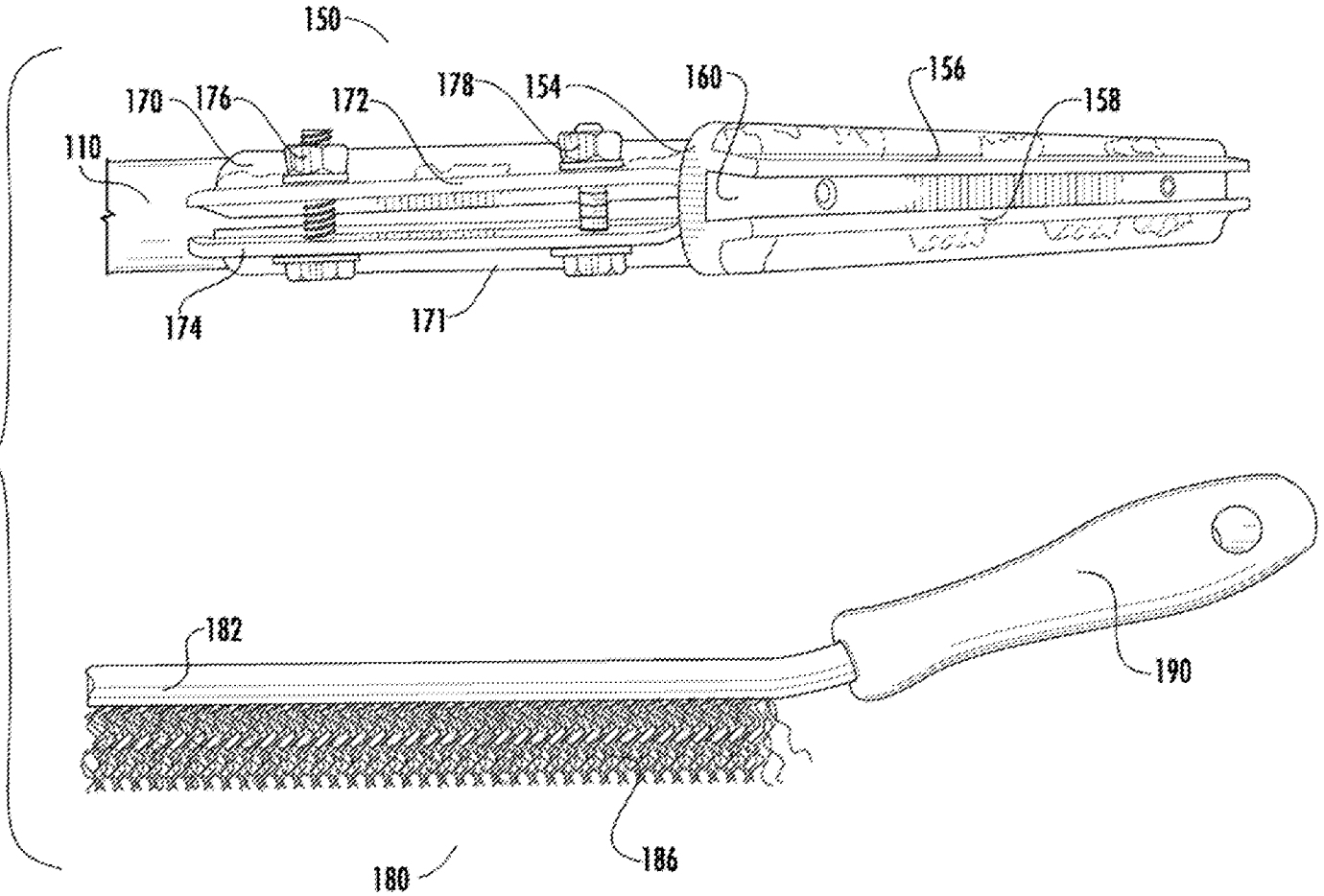
FIG. 4 is a perspective view of a grout cleaning head assembly and a brush subassembly removed from the grout cleaning head assembly.

As seen in FIGS. 2 and 4, grout cleaning head assembly 150 includes a support member 170 secured to the handle rod 120 of elongated handle 110, the support member 170 carrying removable brush subassembly 180. The support 170 is a compression attachment to the elongated handle 110 via compression sleeve 171. Compression sleeve 171 is secured to handle rod 120 via a compression force exerted by bolt assemblies (nut, bolt, washer) 176, 178 at flanges 172, 174 of the compression sleeve. The removable brush subassembly 180 is attached to a head base 154 of the support member 170, at which it is inserted along an insertion axis indicated by the arc B. Insertion axis B is a primary axis of the head base 154, which defines an angle $\alpha$ relative to the center line of the elongate handle 110, arc A. In use of the grout cleaning hand tool 100, the primary axis B of removable brush subassembly 180 is substantially parallel to horizontal. As typically held by an operator in a standing posture (FIGS. 7, 8), the elongate handle 110 extends from the horizontal (plane of floor surface 240) at substantially the angle $\alpha$. In an exemplary embodiment, the elongate handle 110 extends from the primary axis B of removable brush subassembly 180 at an angle of 50°. In various embodiments, angle $\alpha$ is between 40° and 60°. In other embodiments, angle $\alpha$ is between 45° and 55°.

In an exemplary embodiment, dimensions of the grout cleaning head assembly 150 include 6.75" (17.1 cm) length of compression sleeve 171; 4.0" (10.2 cm) length of flanges 172, 174; 6.75" (17.1 cm) length of head base 154; angle $\alpha$ of 50°.

Figure 5:
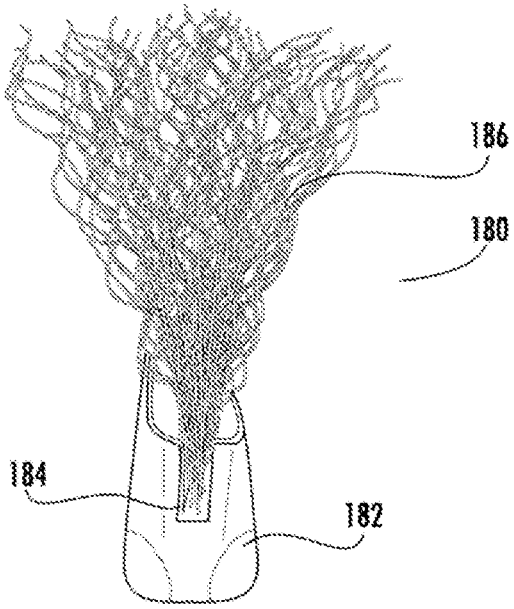
FIG. 5 is a partial end view of a grout cleaning head assembly and a brush subassembly removed from the grout cleaning head assembly.
Figure 5:
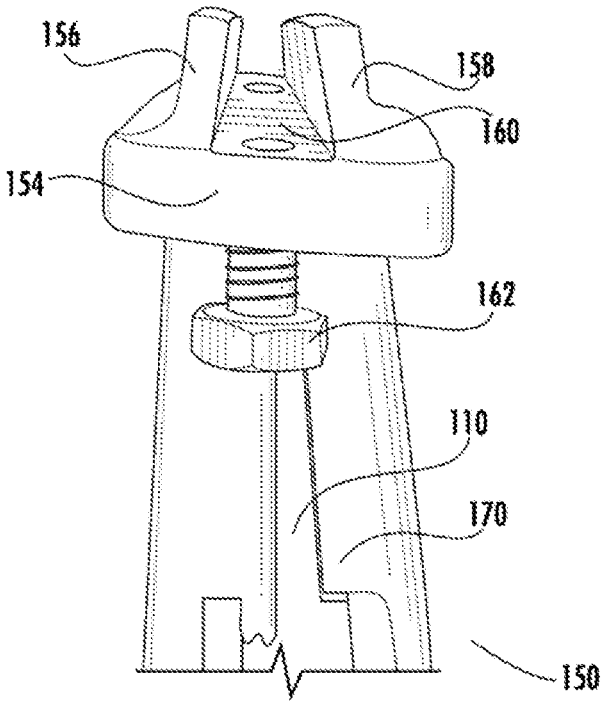

As shown in FIGS. 4 and 5, removable brush subassembly 180 includes a bundle of bristles 186, supported by a brush body 184, and a brush handle 190 extending from one end of the brush body 182. As seen from one end of removable brush subassembly 180, bristles 186 are clamped within a bristle engaging slot 184 of brush body 182. In an embodiment, bristles 186 are stiff bristles that resist collapsing when pressed against the grout lines in the tiled floor. In an exemplary embodiment, bristles 186 are a long narrow bundle of bristle, configured to conform to grout lines in a tiled floor surface. Various materials may be used for bristles 186, such as metals, polymers, horsehair, and composite materials. The crimped metal wire bristles provide a durable bundle of bristles for grout cleaning operations.

In an exemplary embodiment, brush subassembly 180 is an O-Cedar® brand, part #B1573742 Commercial Grout Brush (O-Cedar is a registered trademark of Freudenberg Household Products, Aurora Ill.). This commercial grout brush includes crimped steel wire bristles and a wooden handle, and is 12 inches long (30.5 cm), and 1.5 inches wide (3.8 cm).

The head base 154 defines a channel 160 extending along the insertion axis B. In the illustrated embodiment, the channel 160 is defined between angled rails 156, 158. In an exemplary embodiment, head base 154 is 1" wide (2.54 cm) and 2.5 in. thick (0.635 cm), and angled rails 156, 168 are 0.375" long (0.95 cm) and 0.125" thick (0.32 cm). In an embodiment as seen in FIG. 5, channel 160 is a tapered, substantially trapezoidal slot that has a complementary cross section to that of the elongated brush body 182. Brush body 182 serves as the pin, and channel 160 as the tail, of a dovetail joint between the removable brush subassembly 180 and the head base 154. The user slidably inserts the brush body 184 of brush subassembly 180 into channel 160 along the insertion axis, then locks the brush subassembly 180 within the grout cleaning head assembly 150 by tightening check bolts 162, 164 (FIG. 2).

The removable brush subassembly 180 is removed from grout cleaning head assembly by the reverse procedure. The user may hold the removable brush subassembly 180 at the handle 190 during insertion and removal from the grout cleaning head assembly 150. After removal of brush subassembly 180 from the grout cleaning head assembly 150, the user can use the brush subassembly 180 as a grout cleaning tool.

In an exemplary embodiment, handle rod 120 is a wooden broomstick part, part #7255T2, of McMaster Carr Supply Co., Santa Fe Springs, Calif., 60 inches long (1.52 m), 0.94 inches in diameter (2.38 cm).

Figure 3:
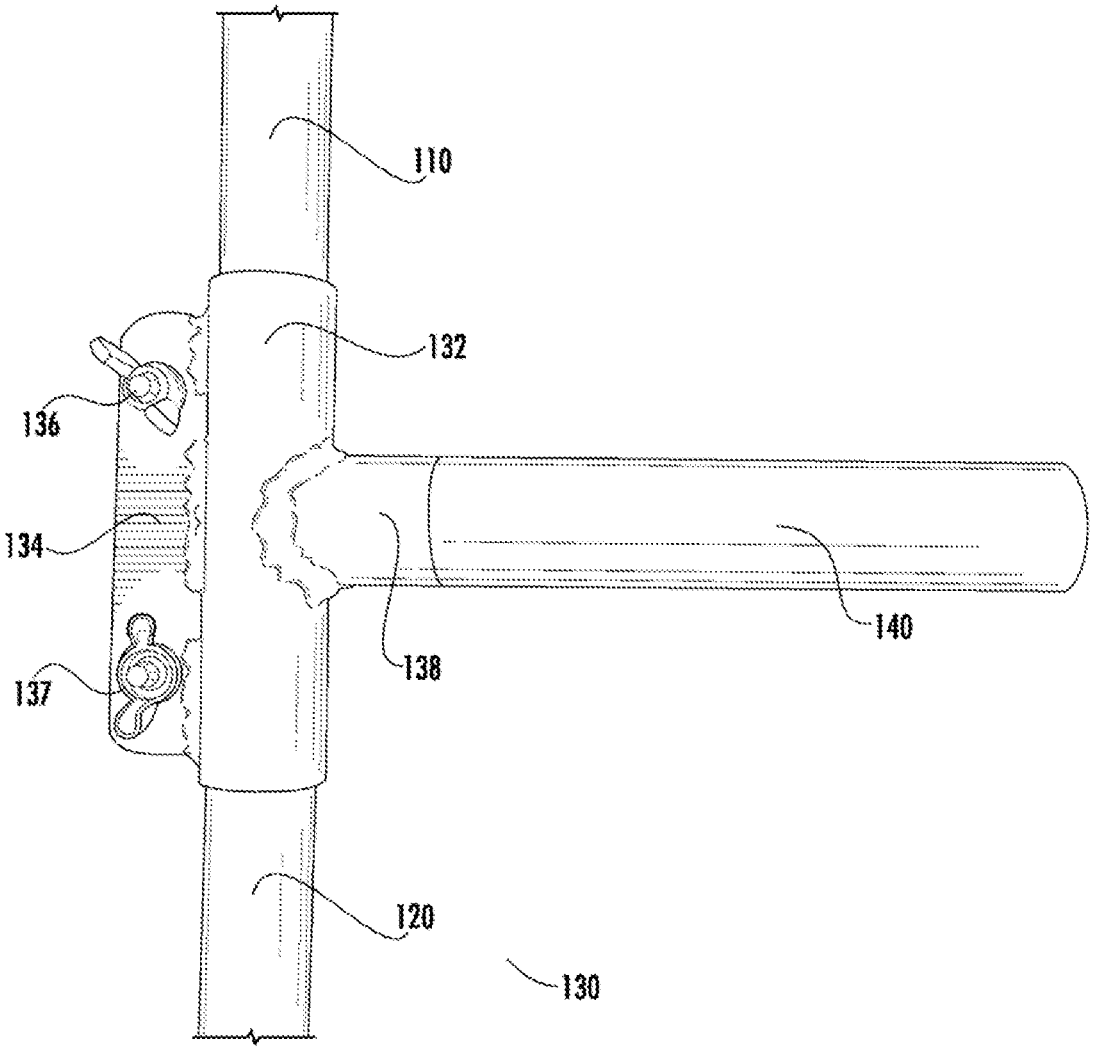
FIG. 3 is a perspective view of an auxiliary T-grip handle of a grout cleaning hand tool.

Referring to FIG. 3, the auxiliary handle 130 includes a sleeve 132 and a T-grip 140 (also called T-grip handle), joined to sleeve 132. T-grip 140 extends substantially perpendicularly from the handle rod 120 of elongate handle 110 at grip base 138. Auxiliary handle 130 is located at an intermediate position between the head assembly 150 and the top end of the handle rod 120, and may be located at a mid-position of the handle rod (as used herein, a mid-position means positioning approximately halfway up handle rod 120). In an exemplary positioning of auxiliary handle 130, the auxiliary handle 130 is located about 33" (84 cm) from the joinder of the center line of elongated handle 110 to head base 154 (i.e., intersection of arcs A, B in FIG. 2).

In an embodiment, T-grip handle 140 has a circular-cylindrical cross section, with a length and diameter suitable for comfortable grasp by an operator wrapping the operator's hand around the handle with fingers around the grip and overlapped by the thumb (power grip). In an embodiment, the handle 140 is thick enough to separate the operator's finger-tips from the palm. In an embodiment, T-grip 140 has a length of 7.0" (17.8 cm) measured from the center line of the elongated handle 110, and a diameter of 1.0" (2.54 cm). The perpendicular orientation of auxiliary handle 130 relative to elongate handle 110 provides ergonomic advantages associated with perpendicular-grip hand tools.

The sleeve 132 is a compression sleeve that is releasably secured to the handle rod 132 by wing nuts 136, 137 at a flange 134 of sleeve 132. An operator may loosen the wing nuts 136 to reposition the auxiliary handle relative to the handle rod 120 of elongate handle 110. This arrangement permits either or both axial repositioning and radial repositioning of the auxiliary handle 130 with respect to the handle rod 120. For example, the auxiliary handle 130 may be rotated to extend toward the right side of the elongate handle 110 relative to the direction faced by the operator 200, or may be rotated to face toward the left side of the elongate handle 110 relative to a direction faced by the operator 200. In other examples, a taller operator may reposition the auxiliary handle to a location higher up the handle rod 120, while a shorter operator may adjust the auxiliary handle 130 a location further down the handle rod 120. In an exemplary embodiment, sleeve 132 is 4.375" long (11.1 cm), and flange 134 is 4" long (10.2 cm) and 0.75" wide (1.9 cm).

Figure 7:
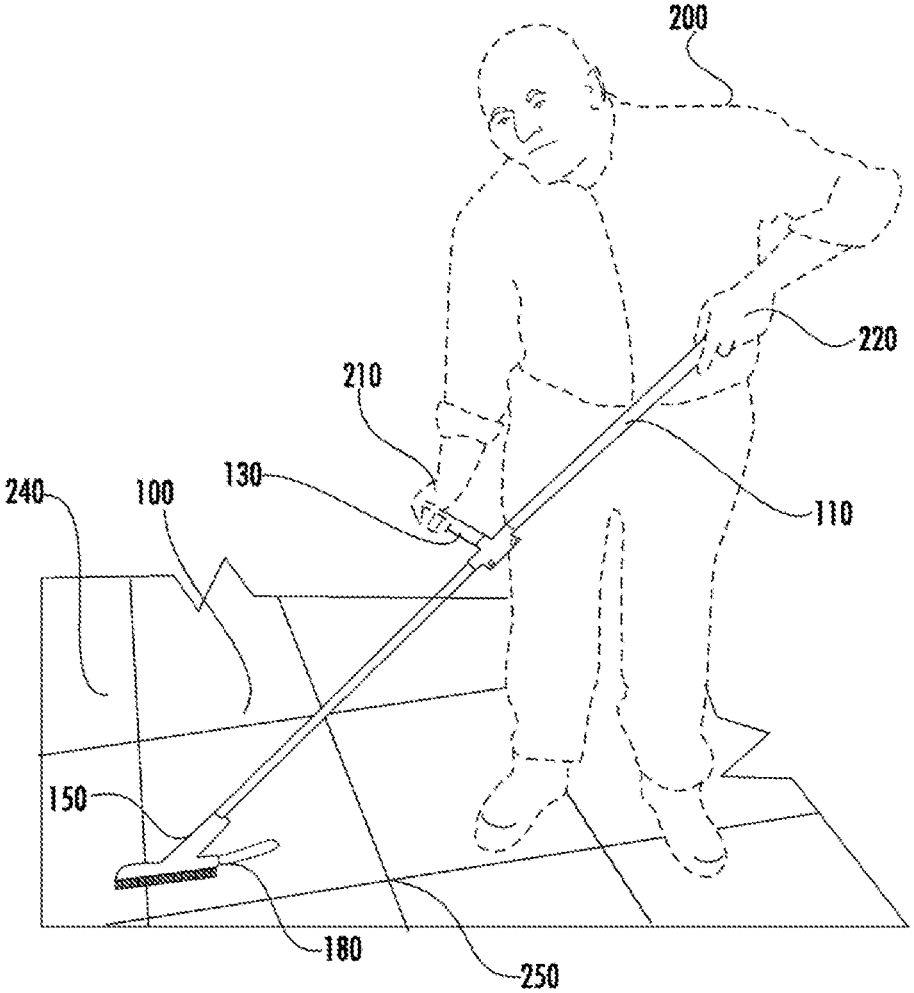
FIG. 7 is a perspective view of an operator cleaning grout lines of a tiled floor holding a grout cleaning tool in a right-handed configuration, in accordance with an embodiment.
Figure 8:
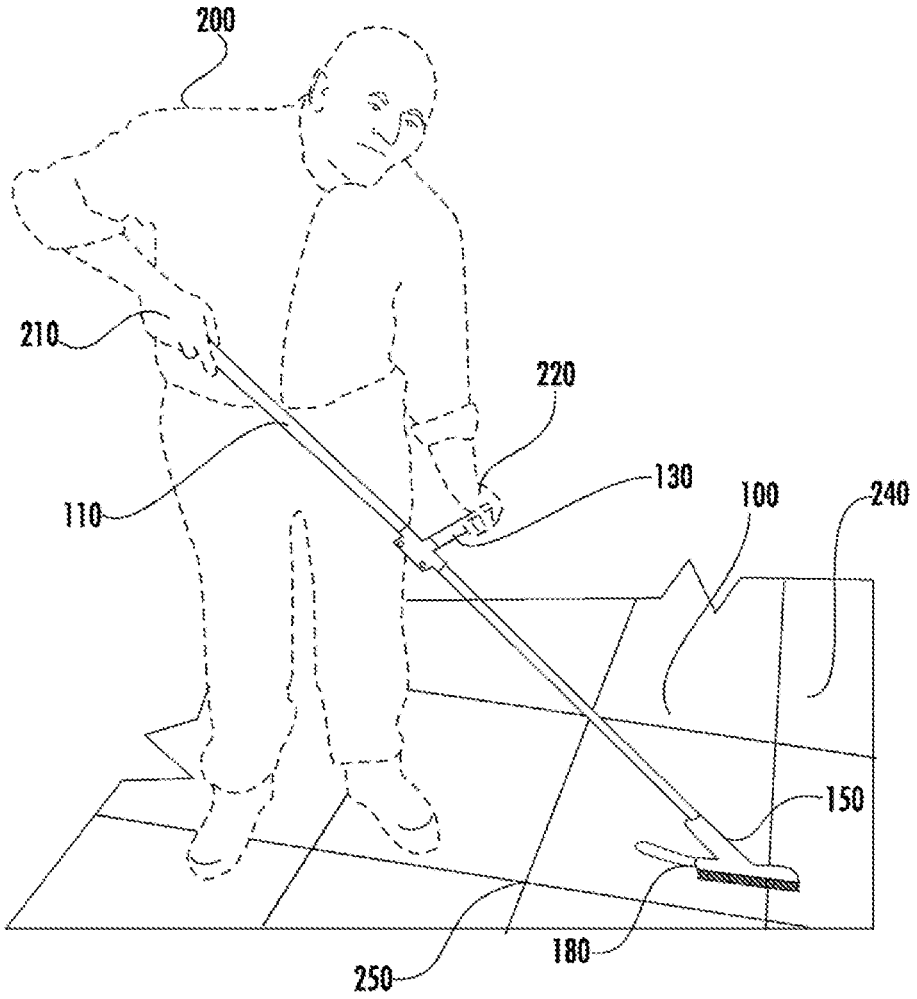
FIG. 8 is a perspective view of an operator cleaning grout lines of a tiled floor holding a grout cleaning tool in a left-handed configuration, in accordance with an embodiment.

FIGS. 7 and 8 show exemplary views of an operator 200 holding the grout cleaning hand tool for cleaning grout of a tiled floor 240. In these figures the operator is shown holding the hand tool above the tiled floor, not in cleaning grout. In FIG. 7, a right-handed operator is holding the elongate handle 110 at its upper end (primary grip position) with his left hand 220, and is holding the auxiliary handle 130 (secondary grip position) with his right hand 210. In FIG. 8, a left-handed operator is holding the elongate handle 110 at its upper end (primary grip position) with his right hand 210, and is holding the auxiliary handle 130 (secondary grip position) with his left hand 220. As compared with FIG. 7, the operator 200 in FIG. 8 has rotated the auxiliary handle 130 to the other side of the elongate handle 110 for left-handed use.

The operator 200 is able to clean grout lines 250 on floor surface 240 while exerting downward compression forces against the grout lines 250. Additionally, the operator can exert considerable force while pushing and/or pulling the grout brush 180 with stiff metal bristles along the grout lines 250. The elongate handle configuration including primary grip and secondary grip positions reduces operator stress and fatigue during grout cleaning. The application of force via elongate handle 110 allows the standing operator to effectively leverage his whole body in grout cleaning. This arrangement provides a mechanical advantage, appreciably increasing the force the operator can exert in grout cleaning. Additionally, the grout cleaning hand tool 100, when employed with a brush subassembly 180 including durable, stiff metal bristles, can clean grout lines in tiled floors using warm water, without requiring any special cleaning agent.

Brush subassembly 180 is configured, when removed from the grout cleaning head assembly 150, for grout cleaning by an operator holding brush subassembly 180 at handle 190 (FIG. 4). For example, brush subassembly 180 may be used in detail work by an operator holding the brush subassembly in a sitting, kneeling, squatting, or crouching posture. Thus, the grout cleaning hand tool 100 is well suited to demanding grout cleaning tasks, e.g., of a large room, by an operator in a standing posture; and to detail work, e.g., near the corners of the room.

The dual grip position elongate handle shown in FIGS. 1, 3, and 6 may be incorporated as a universal handle in a wide variety of hand tools for floor treatment operations. A generalized floor treatment hand tool includes a work head, the work head including a support member and a floor treatment implement secured to the support member. The hand tool further includes an elongate handle that extends upwardly from the support member and is configured to be held by the operator in a standing posture. The elongate handle incorporates a handle rod and an auxiliary handle joined to the handle rod. The handle rod provides a primary grip position for a first hand of the operator, and the auxiliary handle includes a T-grip member. The T-grip member extends substantially perpendicularly to the handle rod, and provides a secondary grip position for a second hand of the operator.

In an embodiment, the work head has a primary axis that normally is substantially parallel to a plane of the floor surface when the floor treatment implement is applied to the floor surface during floor treatment operations. For example, in the embodiment of FIG. 2, axis B is the primary axis of the work head 150. In an embodiment, the elongate handle of the universal handle extends upwardly from the primary axis of the work head at an angle between 40° and 60°. In another embodiment, the elongate handle of the universal handle extends upwardly from the primary axis of the work head at an angle between 45° and 55°.

In an embodiment, the floor treatment hand tool with dual grip position elongate handle is adapted to floor treatment operations that require pressing down the floor treatment implement against a floor surface. The handle rod and the T-grip auxiliary handle provide ergonomically sound grip positions for the operator that help an operator to exert downward compression forces during floor treatment operations, thereby reducing fatigue.

In an embodiment, the floor treatment hand tool with dual grip position elongate handle is adapted to floor treatment operations that require pushing and/or pulling the floor treatment implement against a floor surface. Pushing and pulling operations involving high forces pose a risk of strain injuries. The handle rod and the T-grip auxiliary handle provide ergonomically sound grip positions that facilitate pushing and pulling actions during floor treatment operations.

The floor treatment hand tool with the universal handle allows a standing operator to effectively leverage his whole body in floor treatment operations. The universal handle provides a mechanical advantage to increase effective forces the operator can apply in pressing down, pushing, and/or pulling the floor treatment implement against or along the floor surface.

While various aspects and embodiments have been disclosed, other aspects and embodiments are contemplated. The various aspects and embodiments disclosed are for purposes of illustration and are not intended to be limiting, with the true scope and spirit being indicated by the following claims.

The foregoing method descriptions and the interface configuration are provided merely as illustrative examples and are not intended to require or imply that the steps of the various embodiments must be performed in the order presented. As will be appreciated by one of skill in the art the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be rearranged. A process may correspond to a method, a function, a procedure, a subroutine, a subprogram, etc. When a process corresponds to a function, its termination may correspond to a return of the function to the calling function or the main function.

What is claimed is:

1. A grout cleaning hand tool, comprising:

a grout cleaning head assembly comprising a support member including an insertion axis, and a brush subassembly configured to be inserted to and removed from a channel of the support member along the insertion axis for removable mounting to the support member; wherein the brush subassembly comprises a brush body including a long narrow bundle of bristles extending along the insertion axis between a first end and a second end of the brush body, and a brush handle joined to and extending from the first end of the brush body; wherein the brush subassembly is configured to be inserted to the channel of the support member with the handle joined to the brush body beyond the channel of the support member; wherein the brush body has a tapered cross section and the channel has a complementary cross section to the cross section of the brush body; and an elongate handle joined to the support member, extending upwardly from the grout cleaning head assembly.

2. The grout cleaning hand tool of claim 1, wherein the channel of the support member along the insertion axis is configured to slidably receive the brush body.

3. The grout cleaning hand tool of claim 2, wherein the channel is a tapered slot and the support member includes first and second rails defining the tapered slot.

4. The grout cleaning hand tool of claim 1, wherein the brush body is configured as a pin of a dovetail joint, and the channel of the support member is configured as a tail of the dovetail joint.

5. The grout cleaning tool of claim 1, wherein the long narrow bundle of bristles comprise bristles that are configured to resist collapsing when pressed against grout lines in a tiled floor surface.

6. The grout cleaning tool of claim 5, wherein the long narrow bundle of bristles comprise metal bristles configured to conform to the grout lines in the tiled floor surface.

7. The grout cleaning hand tool of claim 1, wherein the elongate handle comprises a handle rod including a primary grip position configured to be held by a first hand of an operator in the standing posture, and an auxiliary handle joined to the handle rod configured to be held by a second hand of the operator in the standing posture.

8. The grout cleaning hand tool of claim 7, wherein the auxiliary handle comprises a sleeve and a T-grip joined to the sleeve and extending substantially perpendicular to the sleeve, wherein the sleeve is releasably secured to the handle rod to permit either or both axial and radial repositioning of the sleeve along the handle rod.

9. The grout cleaning hand tool of claim 7, wherein the handle rod and the auxiliary handle provide ergonomic positions for the operator holding the elongate handle in the standing posture to exert downward compression forces on the grout cleaning head assembly.

10. The grout cleaning hand tool of claim 1, wherein the elongate handle extends upwardly from the grout cleaning head assembly at an angle between 40° and 60° from the insertion axis.

11. The grout cleaning hand tool of claim 1, wherein the elongate handle extends upwardly from the grout cleaning head assembly at an angle between 45° and 55° from the insertion axis.

12. The grout cleaning hand tool of claim 1, wherein the grout cleaning hand tool is configured for cleaning grout in a floor surface by an operator holding the elongate handle in a standing posture; and wherein the brush subassembly is configured, when removed from the grout cleaning head assembly, for cleaning the grout in the floor surface by the operator holding the brush handle substantially parallel to horizontal.

13. A grout cleaning hand tool comprising:

a grout cleaning head assembly comprising a support member configured to removably receive a brush subassembly, wherein the brush subassembly comprises a brush body, a long narrow bundle of bristles secured to the brush body and configured to resist collapsing when pressed against grout lines in a tiled floor surface, and a brush handle; wherein a channel of the support member is configured to slidably receive the brush body, the brush body is configured as a pin of a dovetail joint, and the channel of the support member is configured as a tail of the dovetail joint; wherein the brush subassembly is configured to be inserted to the channel of the support member with the handle joined to the brush body beyond the dovetail joint between the channel and the brush body; and an elongate handle extending upwardly from the grout cleaning head assembly, wherein the elongate handle comprises a handle rod and an auxiliary handle joined to the handle rod, wherein the support member comprises a compression attachment configured to removably receive the handle rod.

14. The grout cleaning hand tool of claim 13, wherein the handle rod includes a primary grip position configured to be held by a first hand of an operator in the standing posture, and wherein the auxiliary handle includes a secondary grip position configured to be held by a second hand of the operator in the standing posture.

15. The grout cleaning hand tool of claim 13, wherein the auxiliary handle comprises a sleeve and a T-grip joined to the sleeve and extending substantially perpendicular to the sleeve, wherein the sleeve is releasably secured to the handle rod to permit either or both axial and radial repositioning of the sleeve along the handle rod.

16. The grout cleaning hand tool of claim 13, wherein the channel is a tapered slot and the support member includes first and second rails defining the tapered slot.

17. The grout cleaning hand tool of claim 13, wherein the brush subassembly is configured, when removed from the grout cleaning head assembly, for cleaning the grout lines in the tiled floor surface by an operator holding the brush handle joined to the one end of the base substantially parallel to horizontal.

18. A grout cleaning hand tool, comprising:

a grout cleaning head assembly comprising a support member including a channel extending along an insertion axis, and a brush subassembly configured to be inserted to and removed from the channel in the support member for removable mounting to the support member; wherein the support member includes first and second rails defining the channel and the channel is a tapered, substantially trapezoidal slot; wherein the brush subassembly comprises a brush body and a brush handle joined to and extending from one end of the brush body, wherein the brush subassembly is configured to be inserted to the channel of the support member with the handle joined to the brush body beyond the channel of the support member; and a long narrow bundle of bristles secured to the brush body and configured to resist collapsing when pressed against grout lines in a tiled floor surface; and an elongate handle joined to the support member, extending upwardly from the grout cleaning head assembly at an angle between 40° and 60° from the insertion axis, wherein the brush subassembly is configured, when removed from the grout cleaning head assembly, for cleaning the grout lines in the tiled floor surface by an operator holding the brush handle substantially parallel to horizontal.

19. The grout cleaning hand tool of claim 13, wherein the compression attachment comprises a compression sleeve of the support member configured to be secured to the handle rod via a compression force.

* * * * *